US010001253B2

(12) United States Patent
Song

(10) Patent No.: US 10,001,253 B2
(45) Date of Patent: Jun. 19, 2018

(54) LAMP FOR VEHICLE

(71) Applicant: HYUNDAI MOBIS CO., LTD., Seoul (KR)

(72) Inventor: Ki Ryong Song, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days. days.

(21) Appl. No.: 15/587,150

(22) Filed: May 4, 2017

(65) Prior Publication Data

US 2017/0336044 A1 Nov. 23, 2017

(30) Foreign Application Priority Data

May 17, 2016 (KR) ..... 10-2016-0060300

(51) Int. Cl.

| | |
|---|---|
| ***F21V 7/00*** | (2006.01) |
| ***F21S 41/147*** | (2018.01) |
| ***F21S 41/39*** | (2018.01) |
| ***F21S 41/36*** | (2018.01) |
| ***F21S 41/675*** | (2018.01) |
| ***F21S 45/47*** | (2018.01) |

(52) U.S. Cl.
CPC ..... *F21S 41/147* (2018.01); *F21S 41/36* (2018.01); *F21S 41/39* (2018.01); *F21S 41/675* (2018.01); *F21S 45/47* (2018.01)

(58) Field of Classification Search
CPC ..... F21S 48/1757; F21S 48/1305; F21S 48/1159; F21S 41/147; F21S 41/39; F21S 41/675; B60Q 1/0683; B60Q 1/0058
See application file for complete search history.

(56) References Cited

U.S. PATENT DOCUMENTS

| | | | | |
|---|---|---|---|---|
| 7,618,174 | B2 * | 11/2009 | Yasuda | B60Q 1/076 362/512 |
| 9,605,826 | B2 * | 3/2017 | Cabanne | F21S 48/1109 |
| 2005/0018437 | A1 * | 1/2005 | Hori | B60Q 1/12 362/465 |
| 2014/0376232 | A1 * | 12/2014 | Behr | F21S 48/1104 362/294 |
| 2015/0197179 | A1 * | 7/2015 | King | F16H 35/10 362/460 |
| 2015/0204503 | A1 * | 7/2015 | Krenn | F21S 48/1159 362/514 |

* cited by examiner

*Primary Examiner* — William N Harris
(74) *Attorney, Agent, or Firm* — Knobbe Martens Olson & Bear LLP

(57) ABSTRACT

A lamp for a vehicle may include: a plurality of heat dissipation units coupled to each other; a plurality of mounting units coupled to the respective heat dissipation units so as to be adjustable in height; a plurality of reflective units passing through the respective mounting units, and coupled to the respective heat dissipation units so as to be rotatable; a plurality of horizontal angle adjustment units passing through the respective mounting units and engaging with the respective reflective units; and a plurality of light sources provided in the respective heat dissipation units such that the light sources face the respective reflective units.

5 Claims, 6 Drawing Sheets

LAMP FOR VEHICLE

CROSS-REFERENCES TO RELATED APPLICATIONS

The present application claims priority to Korean application number 10-2016-0060300, filed on May 17, 2016, which is incorporated by reference in its entirety.

BACKGROUND OF THE INVENTION

The present invention relates to a lamp for a vehicle, and more particularly, to a lamp for a vehicle capable of individually aiming a plurality of optical modules.

Recently, as semiconductor light sources such as light emitting diodes (LEDs) are used as lamps (e.g., headlamps) for vehicles, a matrix lighting structure using LEDs and a plurality of optical modules is employed in lamps for vehicles.

In the case of a lamp for a vehicle using the LEDs and the optical modules, a structure capable of individually aiming optical modules is essential so as to provide intended lighting performance.

In the case of a lamp for a vehicle using a conventional single optical module, aiming of the optical module is performed in such a way that a plurality of ball joints are provided on a base plate, optical systems such as reflectors are pivotally moved upward, downward, leftward, or rightward on the ball joints, and then the optical systems are fixed by a plurality of screws.

However, if the conventional aiming method is used in a lamp for a vehicle using a plurality of optical modules, there is a problem in that the number of required parts and the number of manufacturing processes are increased.

SUMMARY OF THE INVENTION

Embodiments of the present invention are directed to a lamp for a vehicle using an aiming unit having an improved structure capable of individually the heights and the horizontal angles of a plurality of optical systems.

In one embodiment, a lamp for a vehicle may include: a plurality of heat dissipation units coupled to each other; a plurality of mounting units coupled to the respective heat dissipation units so as to be adjustable in height; a plurality of reflective units passing through the respective mounting units, and coupled to the respective heat dissipation units so as to be rotatable; a plurality of horizontal angle adjustment units passing through the respective mounting units and engaging with the respective reflective units; and a plurality of light sources provided in the respective heat dissipation units such that the light sources face the respective reflective units.

Each of the heat dissipation units may include a protrusion protruding from one surface of the heat dissipation unit toward the corresponding reflective unit.

Each of the reflective units may include a cylindrical part into which the protrusion is inserted.

The protrusion may include a flange provided around an outer circumferential surface thereof. The cylindrical part may have a flange groove formed in an inner circumferential surface thereof. The flange may be inserted into the flange groove.

A width of the flange groove may be greater than a thickness of the flange.

A height adjustment hole may be formed in each of the heat dissipation units. The lamp may further include a plurality of height adjustment units, each of the height adjustment units including a height adjustment bolt threaded into the height adjustment hole through the corresponding mounting unit, and a height adjustment spring provided around the height adjustment bolt.

Each of the mounting units may include: a horizontal mounting member through which the height adjustment bolt passes; and a pair of vertical mounting members vertically extending from the horizontal mounting member.

The horizontal mounting member may include a first through hole through which the cylindrical part passes, and a second through hole through which the height adjustment bolt passes. Each of the vertical mounting members may include a third through hole through which the horizontal angle adjustment unit passes.

Each of the horizontal angle adjustment units may linearly move forward or backward so that a horizontal angle of the corresponding reflective unit is adjusted.

Gear teeth may be formed in each of the reflective units, the gear teeth engaging with the corresponding horizontal angle adjustment unit.

Any one of the reflective units may be fixed to any one of the heat dissipation units.

Respective front ends of the heat dissipation units may be disposed on different lines.

A lamp for a vehicle in accordance with the present invention uses an aiming unit having an improved structure so that heights and horizontal angles of a plurality of optical systems can be individually adjusted.

Furthermore, the number of parts required for aiming the plurality of optical systems and the number of manufacturing processes can be reduced.

DESCRIPTION OF SPECIFIC EMBODIMENTS

Hereinafter, a lamp for a vehicle in accordance with embodiments of the invention will be described in detail with reference to the accompanying drawings.

It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

In the specification, when an element is referred to as "comprising" or "including" a component, it does not preclude another component but may further include other components unless the context clearly indicates otherwise.

Figure 1:
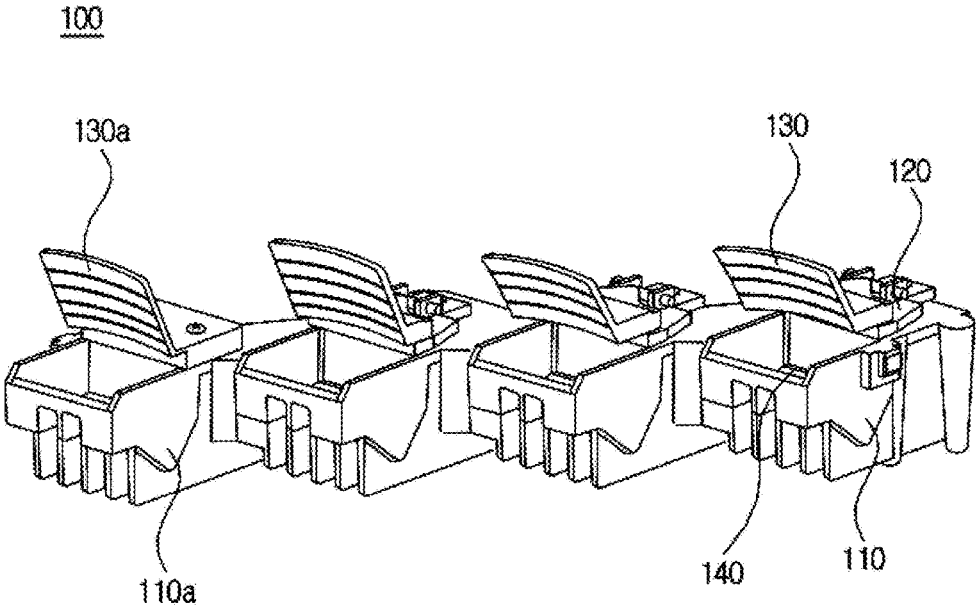
FIG. 1 is a perspective view illustrating a lamp for vehicles in accordance with an embodiment of the present invention.
Figure 2:
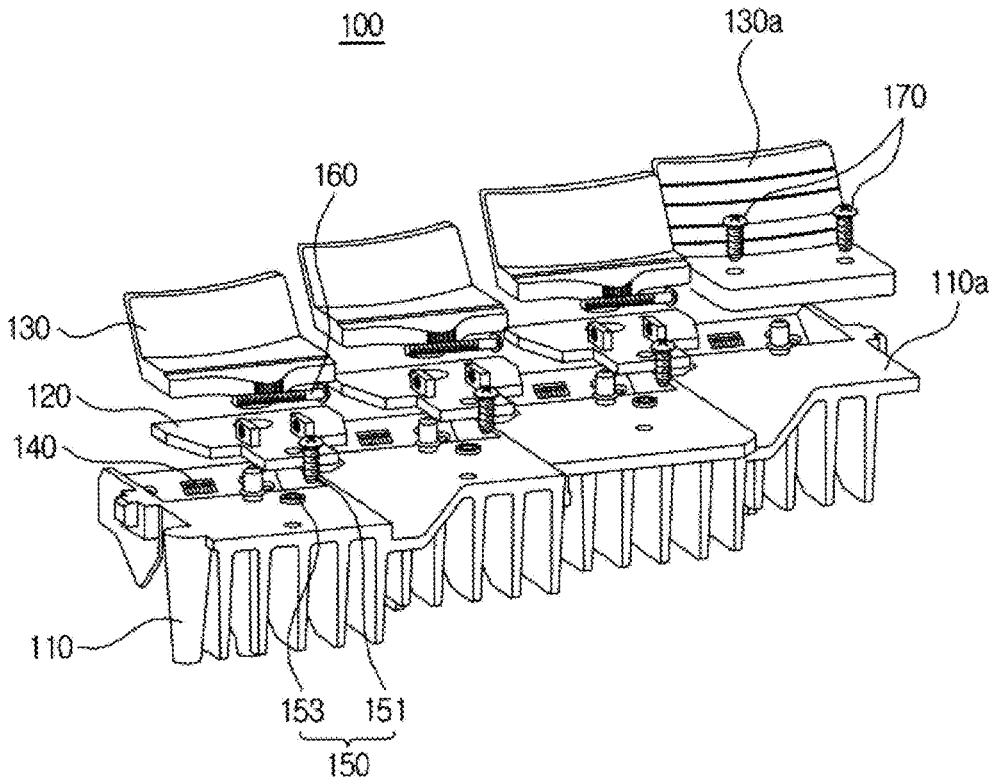
FIG. 2 is an exploded perspective view the lamp for vehicles in accordance with an embodiment of the present invention.

Referring to FIGS. 1 and 2, a lamp 100 for a vehicle having an individually aimable structure in accordance with an embodiment of the present invention includes a plurality of heat dissipation units 110, a plurality of mounting units 120, a plurality of reflective units 130, a plurality of light sources 140, a plurality of height adjustment units 150, a plurality of horizontal angle adjustment units 160, and fasteners 170.

The mounting units 120 are coupled, so as to be adjustable in height, to the respective heat dissipation units 110 provided with the light sources 140. The reflective units 130 are rotatably coupled to the respective heat dissipation units 110.

The horizontal angle adjustment units 160 pass through the respective mounting units 120 and engage with the respective reflective units 130 so that the heights and the horizontal angles of the reflective units 130 can be individually adjusted.

Although each heat dissipation unit 110 is provided to dissipate heat generated from the corresponding light source 140, it may also function as a base for coupling various optical systems (e.g., the reflective unit 130) with aiming members (e.g., the mounting unit 120, the height adjustment unit 150, the horizontal angle adjustment unit 160, and the fasteners 170). In an embodiment, as shown in FIGS. 1 and 2, four heat dissipation units 110 may be provided, but the present invention is not limited thereto, for example, less or more than four heat dissipation units may be provided.

Any one heat dissipation unit 110*a* of the heat dissipation units 110 may function as a reference unit for aiming. Any one reflective unit 130*a* of the reflective units 130 may be fixed to the heat dissipation unit 110*a* that is the reference unit for aiming. The reflective unit 130*a* is fixed to the heat dissipation unit 110*a* by the fasteners 170. Here, each fastener 170 may be a male bolt. The fastener 170 is tightened into the heat dissipation unit 110*a* via the reflective unit 130*a*.

As such, if any one reflective unit 130*a* of the reflective units 130 is fixed to the heat dissipation unit 110*a* that functions as the reference unit for aiming, the other reflective units 130 can be individually aimed with reference to the reflective unit 130*a* fixed to the heat dissipation unit 110*a* that functions as the reference unit for aiming.

In order to make the reflective units 130 aimed individually without interfering with each other, respective front ends (visible portions in FIG. 1) of the heat dissipation units 110 may be disposed on different lines when sidewalls of the heat dissipation units 110 are coupled to each other. In other words, the plurality of heat dissipation units 110 may be formed in a stepped shape. The foregoing structure can prevent the reflective units 130 from interfering with each other when rotational angles thereof are adjusted.

Figure 3:
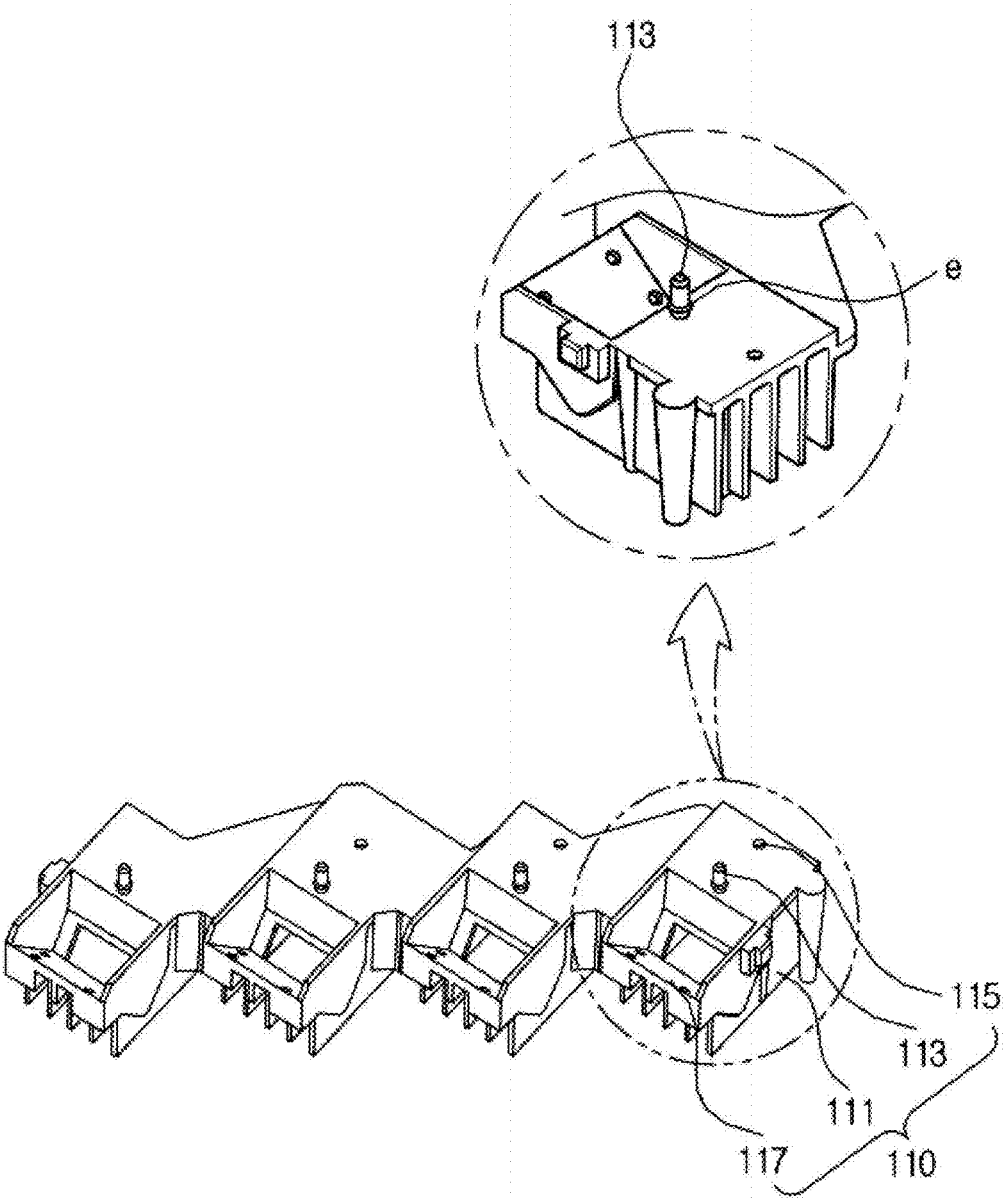
FIG. 3 is a perspective view illustrating a heat dissipation unit of the lamp for vehicles in accordance with an embodiment of the present invention.

Referring to FIG. 3, the heat dissipation unit 110 may includes a heat dissipation body 111, a protrusion 113, a height adjustment hole, and an LED mounting surface 117.

The heat dissipation body 111 may generally have a box shape, but it is not limited thereto. An upper portion of the heat dissipation body 111 may be sectioned into one surface to which the mounting unit 120 and the reflective unit 130 are coupled, and the LED mounting surface 117 to which the light source 140 is mounted. The LED mounting surface 117 may be inclined at a predetermined angle. The reason for this is to make the light source 140 face the reflective unit 130 when the light source 140 is mounted to the LED mounting surface 117. The light source 140 may be an LED light source.

A lower portion of the heat dissipation body 111 may be provided with heat dissipation fins for dissipating heat of the light source 140. The heat dissipation fins assist in a rapid reduction in the temperature of the light source 140.

The protrusion 113 and the height adjustment hole 115 are provided in the one surface of the heat dissipation body 111. The protrusion 113 is provided to couple the heat dissipation body 111 with the reflective unit 130, and may protrude upward from the one surface of the heat dissipation body 111. The protrusion 113 may be cylindrical.

A flange e may be provided around the circumferential surface of the protrusion 113. The flange e may function to couple the reflective unit 130 with the heat dissipation unit 110. Description will be made for an example of the coupling of the reflective unit 130 with the heat dissipation unit 110 using the flange e.

The height adjustment hole 115 may be formed in a shape in which it is depressed inward in the one surface of the heat dissipation body 111. The height adjustment unit 150 for adjusting the height of the mounting unit 120 may be coupled to the height adjustment hole 115.

Referring again to FIG. 2, the height adjustment unit 150 may include a height adjustment bolt 151 and a height adjustment spring 153. The height adjustment bolt 151 may be threaded into the height adjustment hole 115 after passing through the mounting unit 120.

Here, the height adjustment spring 153 may be disposed enclosing the circumference of the height adjustment bolt 151. When the height adjustment bolt 151 is coupled into the height adjustment hole 115, the height adjustment spring 153 is maintained in a compressed state with one end thereof brought into close contact with the mounting unit 120. If the height adjustment bolt 151 is moved from the height adjustment hole 115 to a predetermined height, the mounting unit 120 is moved upward by the elastic restoring force of the height adjustment spring 153 so that the height of the mounting unit 120 can be adjusted.

Figure 4:
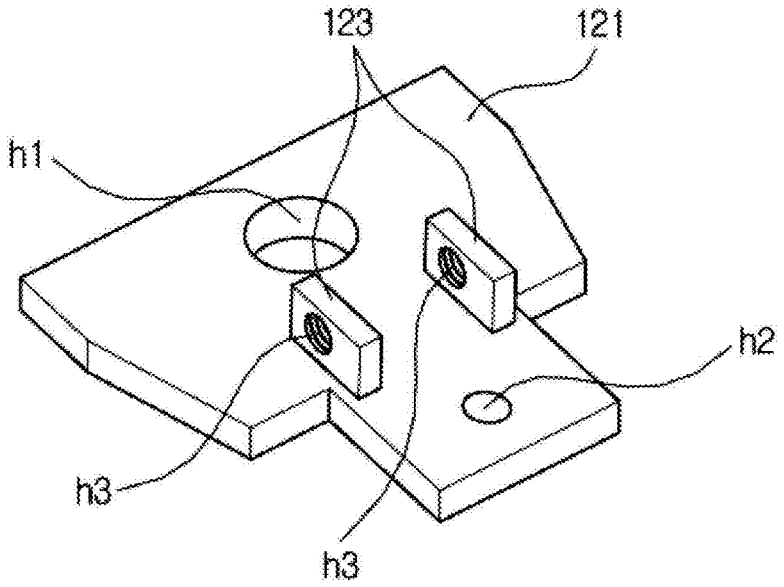
FIG. 4 is a perspective view illustrating a mounting unit of the lamp for vehicles in accordance with an embodiment of the present invention.

Referring to FIG. 4, the mounting unit 120 may be provided to adjust the height and the horizontal angle of the reflective unit 130, and may include a horizontal mounting member 121 and a vertical mounting member 123.

The horizontal mounting member 121 may be provided between the heat dissipation unit 110 and the reflective unit 130. The horizontal mounting member 121 may have a first through hole h1 through which the protrusion 113 of the heat dissipation unit 110 passes, and a second through hole h2 through which the height adjustment bolt 151 of the height adjustment unit 150 passes.

The vertical mounting member 123 may comprise a pair of vertical mounting members 123 which vertically extending from the horizontal mounting member 121. A third through hole h3 may be formed in each of the vertical mounting member 123, and the horizontal angle adjustment unit 160 may pass through the third through holes h3 of the vertical mounting members 123.

Referring again to FIG. 2, the horizontal angle adjustment unit 160 which is provided to adjust the horizontal angle of the reflective unit 130 may be disposed passing through the third through holes h3 of the vertical mounting members 123. The horizontal angle adjustment unit 160 may be a male bolt.

The horizontal angle adjustment unit 160 may engage with the reflective unit 130. When the horizontal angle adjustment unit 160 linearly moves forward or backward in the third through holes h3 of the vertical mounting members 123, the reflective unit 130 that engages with the horizontal angle adjustment unit 160 is rotated, whereby the horizontal angle of the reflective unit 130 can be adjusted.

Figure 5:
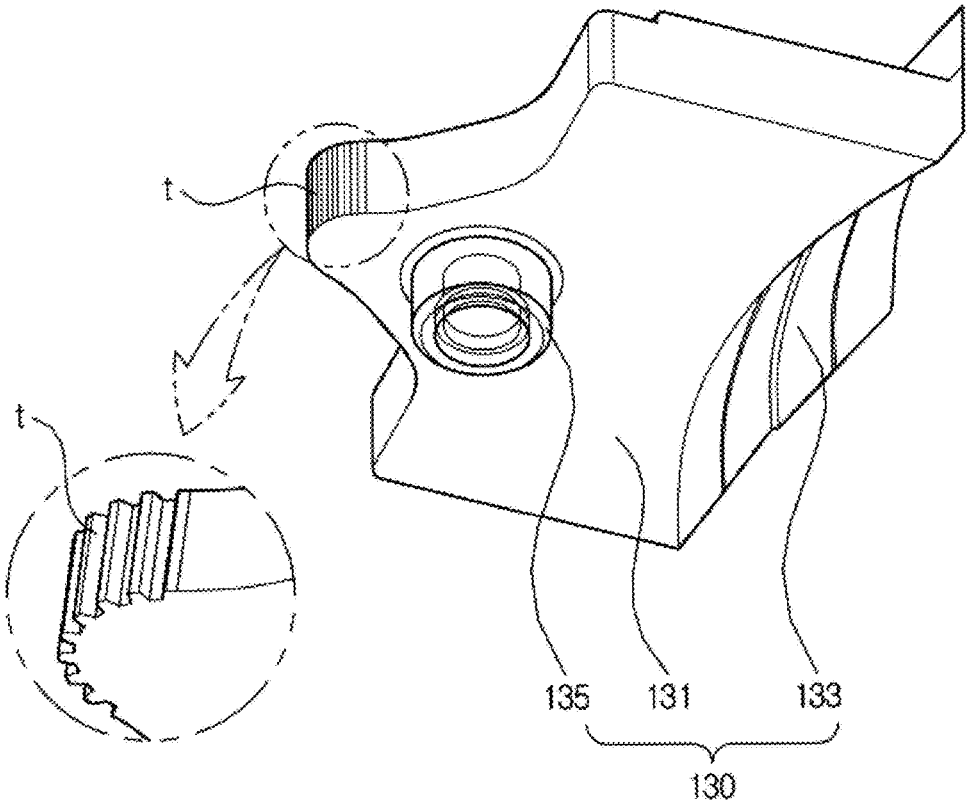
FIG. 5 is a perspective view illustrating a reflective unit of the lamp for vehicles in accordance with an embodiment of the present invention.
Figure 6:
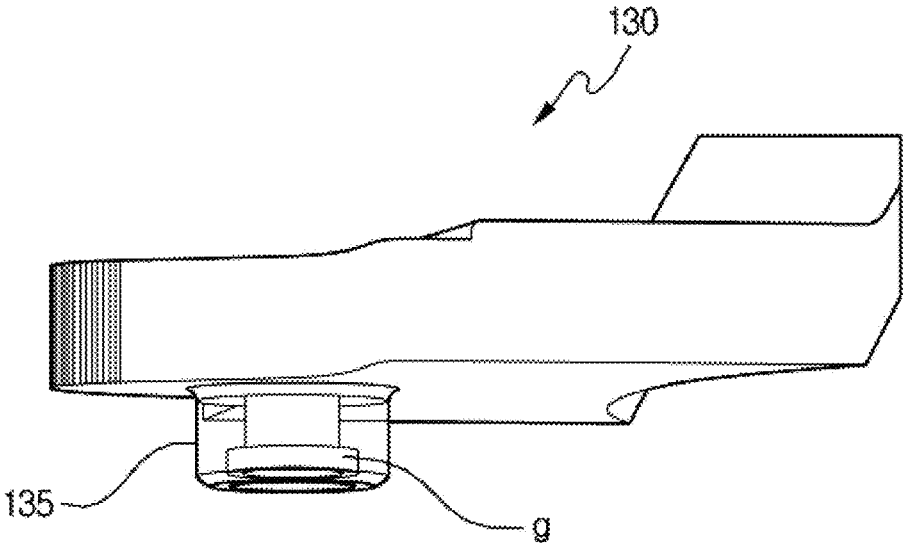
FIG. 6 is a side sectional view illustrating the reflective unit of the lamp for vehicles in accordance with an embodiment of the present invention.

Referring to FIGS. 5 and 6, the reflective unit 130 functions to reflect light generated from the light source 140 so as to enhance the visibility in front of the vehicle. The reflective unit 130 may includes a reflective body 131, a reflective surface 133, and a cylindrical part 135.

The reflective body 131 may be provided parallel both to the one surface of the heat dissipation unit 110 and to the horizontal mounting member 121. Facing the light source 140, the reflective surface 133 may be provided on a front end of the reflective body 131. Gear teeth t may be provided on a rear end of the reflective body 131.

The gear teeth t of the reflective body 131 may engage with the horizontal angle adjustment unit 160, as described above. The reflective body 131 may be rotated by the movement of the horizontal angle adjustment unit 160 through the gear teeth t that engage with the horizontal angle adjustment unit 160.

The cylindrical part 135 may be provided under a lower surface of the reflective body 131. The cylindrical part 135 may be formed extending vertically from the lower surface of the reflective body 131. The cylindrical part 135 may pass through the first through hole h1 of the horizontal mounting member 121. The protrusion 113 of the heat dissipation unit 110 may be inserted into the cylindrical part 135.

A flange groove g may be formed in an inner circumferential surface of the cylindrical part 135. The flange e of the protrusion 113 may be inserted into the flange groove g so that the reflective unit 130 is coupled with the heat dissipation unit 110.

To allow the height of the reflective unit 130 to be adjusted using the height adjustment unit 150, it is preferable that the width of the flange groove g be greater than the thickness of the flange e. Thus, the height of the reflective unit 130 can be adjusted by the height adjustment unit 150 by a distance between the flange e and the surface of a portion of the cylindrical part 135 that defines the flange groove g.

As described above, the lamp 100 for vehicles in accordance with an embodiment of the present invention employs an improved type aiming unit (including the mounting unit 120, the height adjustment unit 150, and the horizontal angle adjustment unit 160), whereby the height and the horizontal angle of each reflective unit 130 can be individually adjusted.

Although preferred embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. A lamp for a vehicle comprising:

a plurality of heat dissipation units coupled to each other;

a plurality of mounting units coupled to the plurality of heat dissipation units respectively, each mounting unit being height-adjustable;

a plurality of reflective units passing through the plurality of mounting units respectively, each plurality of reflective unit being rotatably coupled to a corresponding heat dissipation unit;

a plurality of horizontal angle adjustment units passing through the plurality of mounting units respectively, each of plurality of horizontal angle adjustment units engaging with a corresponding reflective unit; and a plurality of light sources provided in the plurality of heat dissipation units respectively such that each light source faces a corresponding reflective unit;

wherein each heat dissipation unit comprises a protrusion protruding from one surface thereof toward its corresponding reflective unit, wherein the protrusion comprises a flange provided around an outer circumferential surface thereof, wherein each of the reflective units comprises a cylindrical part into which the protrusion is inserted, wherein the cylindrical part has a flange groove formed in an inner circumferential surface thereof, and wherein the flange is inserted into the flange groove.

2. The lamp of claim 1, wherein a width of the flange groove is greater than a thickness of the flange.

3. A lamp for a vehicle comprising:

a plurality of heat dissipation units coupled to each other;

a plurality of mounting units coupled to the plurality of heat dissipation units respectively, each mounting unit being height-adjustable;

a plurality of reflective units passing through the plurality of mounting units respectively, each plurality of reflective unit being rotatably coupled to a corresponding heat dissipation unit;

a plurality of horizontal angle adjustment units passing through the plurality of mounting units respectively, each horizontal angle adjustment unit engaging with a corresponding reflective unit; and a plurality of light sources provided in the plurality of heat dissipation units respectively such that each light source faces a corresponding reflective unit;

wherein each heat dissipation unit comprises a protrusion protruding from one surface thereof toward its corresponding reflective unit, wherein each of the reflective units comprises a cylindrical part into which the protrusion is inserted, wherein a height adjustment hole is formed in each of the heat dissipation units, wherein the lamp further comprises a plurality of height adjustment units, each height adjustment unit comprising a height adjustment bolt threaded into the height adjustment hole through the corresponding mounting unit and further comprising a height adjustment spring provided around the height adjustment bolt, wherein each mounting unit comprises a horizontal mounting member through which the height adjustment bolt passes, and a pair of vertical mounting members vertically extending from the horizontal mounting member, wherein the horizontal mounting member includes a first through hole through which the cylindrical part passes, and a second through hole through which the height adjustment bolt passes, and wherein each of the vertical mounting members includes a third through hole through which the horizontal angle adjustment unit passes.

4. The lamp of claim 3, wherein each of the horizontal angle adjustment units linearly moves forward or backward so that a horizontal angle of the corresponding reflective unit is adjusted.

5. The lamp of claim 4, wherein gear teeth are formed in each of the reflective units, the gear teeth engaging with the corresponding horizontal angle adjustment unit.

* * * * *